US005093768A

United States Patent [19]

Ohe

[11] Patent Number: 5,093,768

[45] Date of Patent: Mar. 3, 1992

[54] SIGNAL LAMP COMPOSED OF LIGHT EMITTING DIODES FOR VEHICLE

[75] Inventor: Kouji Ohe, Koshigaya, Japan

[73] Assignee: Stanley Electric Co., Ltd., Japan

[21] Appl. No.: 601,514

[22] Filed: Oct. 23, 1990

[30] Foreign Application Priority Data

Oct. 27, 1989 [JP] Japan ..... 1-125890[U]

[51] Int. Cl.[5] ..... F21V 1/00

[52] U.S. Cl. ..... 362/241; 362/237; 362/240; 362/297; 362/346; 362/800; 313/114; 313/512

[58] Field of Search ..... 362/227, 237, 240, 241, 362/297, 346, 800; 313/500, 110, 114, 512

[56] References Cited

U.S. PATENT DOCUMENTS

| | | | |
|---|---|---|---|
| 3,875,456 | 4/1975 | Kano et al. | 313/110 |
| 4,013,915 | 3/1977 | Dufft | 313/512 |
| 4,603,496 | 8/1986 | Latz et al. | 313/500 |
| 4,628,422 | 12/1986 | Ewald | 362/800 |
| 4,698,730 | 10/1987 | Sakai et al. | 362/800 |
| 4,742,432 | 5/1988 | Thillays et al. | 362/800 |

*Primary Examiner*—Ira S. Lazarus

*Assistant Examiner*—Sue Hagarman

*Attorney, Agent, or Firm*—Louis Weinstein

[57] ABSTRACT

An improved signal lamp for a vehicle is composed of a plurality of dome type light emitting diodes and a plurality of reflective mirrors arranged corresponding to the light emitting diodes. Each of the reflective mirrors is designed in the shape of a rotational parabolic surface whose focus is located at the position coincident to the foremost end of the corresponding light emitting diode or at the position in the vicinity of the foremost end of the corresponding light emitting diode. The rotational parabolic surface is configured such that a virtual light source appearing on each light emitting diode is located at the position coincident with the focus of the corresponding reflective mirror or at the position in the vicinity of the focus of the corresponding reflective mirror. Each light emitting diode chip is sealably received in a transparent cylindrical case molded of synthetic resin such that a large part of light generated by the light emitting diode chip is emitted directly from the light emitting diode chip so as to allow it to be radiated to the outside through the lens portion at a radiating angle ranging from 10° to 12° as measured from the optical axis.

9 Claims, 2 Drawing Sheets

SIGNAL LAMP COMPOSED OF LIGHT EMITTING DIODES FOR VEHICLE

BACKGROUND OF THE INVENTION

1. Field of the Invention

The present invention relates generally to a signal lamp composed of a plurality of light emitting diodes for a vehicle. More particularly, the present invention relates to a signal lamp for a vehicle, e.g., a motorcar composed of a plurality of dome type light emitting diodes and a plurality of reflective mirrors arranged corresponding to the light emitting diodes (LEDs) wherein the signal lamp is employed for a brake lamp and each light emitting diode serves as a light source.

2. Description of the Related Art

FIG. 3 is a sectional view which illustrates the foregoing kind of conventional signal lamp 31 for a vehicle composed of a plurality of light emitting diodes and a plurality of reflective mirrors arranged corresponding to the light emitting diodes. The conventional signal lamp 31 is constructed such that a plurality of light emitting diodes 32, each including a so-called dome type light emitting diode chip 32*a* which is sealably received in a substantially cylindrical transparent case 32*c* molded of synthetic resin and of which the foremost end part serves as a lens portion 32*b*, are arranged in an equally spaced relationship with a predetermined distance kept between the adjacent LEDs, a plurality of reflective mirrors 33 each having a focus located at the light emitting diode chip 32*a* are disposed behind the respective light emitting diodes 32 and a lens 34 transversely extends in front of the respective light emitting diodes 32 and the reflective mirrors 33 to cover them therewith.

With the conventional signal lamp 31 as constructed in the above-described manner, properties of light emitting and reflecting are determined mainly depending on the lens portions 32*b* of the cases 32*c*. Thus, a principal object of each reflective mirror 33 is to emit light to the intermediate region between the adjacent light emitting diodes 32 so as to uniformly illuminate the surface of the lens 34.

However, it has been found that based on the results derived from careful examination on the light emitting diode 32, since the light emitting diode chip 32*a* of the light emitting diode 32 is mounted on the bottom of a dish-shaped horn portion 32*e* (see FIG. 4) formed on a lead frame 32*d* for the purpose of raising a level of efficiency, many ineffective spots appear on the reflective mirror 33 of which focus is located at the light emitting diode chip 32*a*, due to formation of light intercepting spots and thereby it becomes impossible to uniformly illuminate the surface of the lens 34. For these reasons, the conventional signal light 31 has a problem that brightness fluctuates over the surface of the lens 34 and thereby most of users feel unsatisfactory in respect of a quality of the conventional signal lamp.

SUMMARY OF THE INVENTION

The present invention has been made with the foregoing background in mind.

Therefore, an object of the present invention is to provide a signal lamp composed of a plurality of light emitting diodes for a vehicle wherein brightness does not fluctuate at any position on the surface of a lens of the signal lamp.

To accomplish the above object, the present invention provides a signal lamp for a vehicle composed of a plurality of dome type light emitting diodes and a plurality of reflective mirrors arranged corresponding to the light emitting diodes, wherein each of the reflective mirrors is designed in the shape of a rotational parabolic surface of which focus is located at the position coincident to the foremost end of the corresponding light emitting diode or at the position in the vicinity of the foremost end of the corresponding light emitting diode.

The rotational parabolic surface is contoured such that a virtual light source appearing on each light emitting diode is located at the position coincident to the focus of the corresponding reflective mirror or at the position in the vicinity of the focus of the corresponding reflective mirror.

Each light emitting diode chip is sealably received in a case molded of synthetic resin such that a large part of light generated by the light emitting diode chip is emitted directly from the light emitting diode chip so as to allow it to be radiated to the outside through a lens portion peripheral to the straight part of the case by a predetermined radiating angle.

The light emitting diode is sealably received in the case which is contoured such that a part of light generated by the light emitting diode chip is reflected at the lens portion and the reflected light is then emitted to the outside toward the rotational parabolic surface of the reflective mirror via diffraction in the lens portion.

Further, the light emitting diode chip is sealably received in the case which is contoured such that another part of the generated light is reflected at the lens portion and the reflected light is then emitted to the outside toward the rotational parabolic surface of the reflective mirror via diffraction in the straight part of the case.

Thus, according to the present invention, the whole surface of each reflective mirror is brightly illuminated without fluctuation of brightness on the lens portion of the light emitting diode, whereby the lens of the signal lamp is uniformly illuminated without fluctuation of brightness at any position of the surface thereof.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENT

Now, the present invention will be described in detail hereinafter with reference to the accompanying drawings which illustrate a preferred embodiment of the present invention.

Figure 1:
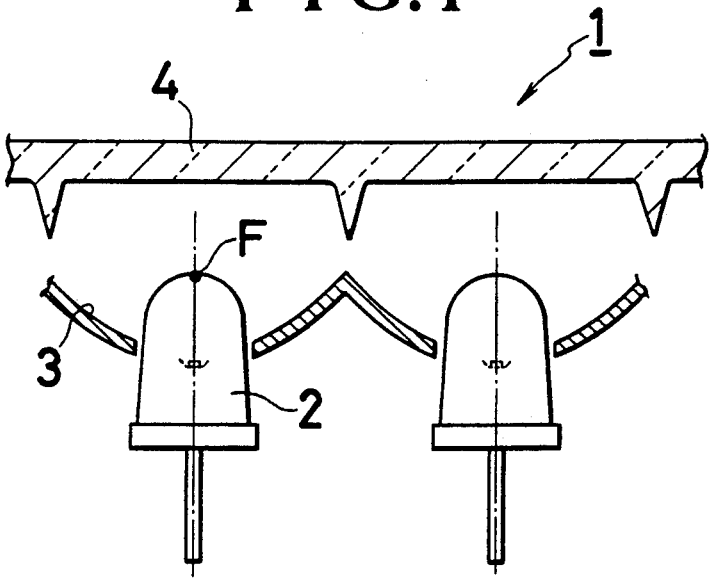
FIG. 1 is a sectional view of a signal lamp composed of a plurality of light emitting diodes for a vehicle in accordance with an embodiment of the present invention.
Figure 3:
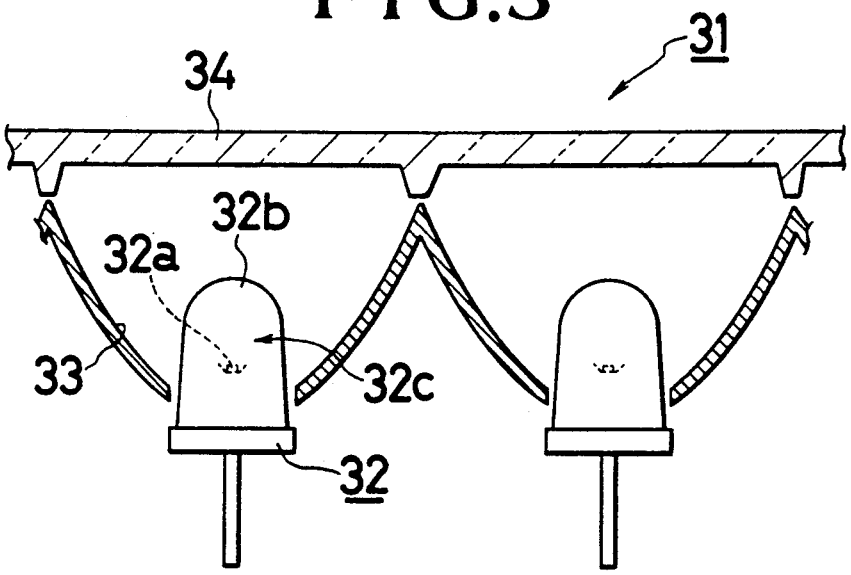
FIG. 3 is a sectional view of a conventional signal lamp composed of a plurality of light emitting diodes for a vehicle.
Figure 4:
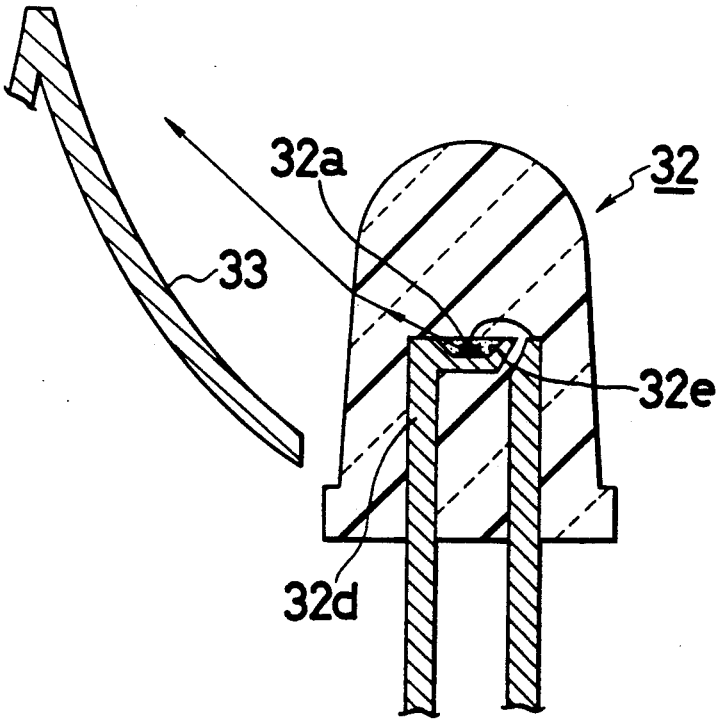
FIG. 4 is an enlarged sectional view which illustrates an optical function resulting from a reflective mirror for the conventional signal lamp in FIG. 3.

In FIG. 1, reference numeral 1 designates a signal lamp for a vehicle composed of a plurality of light emitting diodes and a plurality of reflective mirrors arranged corresponding to the light emitting diodes (hereinafter referred to simply as a signal lamp for the purpose of simplification). A plurality of dome type light emitting diodes 2 are employed for the signal lamp 1 as light sources, and a reflective mirror 3 is arranged corresponding to each light emitting diode 2. As is apparent from the drawing, the reflective mirror 3 is designed in the shape of a rotational parabolic surface, with the axis of rotation being coincident with optical axis, and a lens 4 for signal lamp 1 is disposed in front of the reflective mirror 3 in the same manner as the conventional signal lamp which has been described above with reference to FIG. 3 and FIG. 4. In contrast with the conventional signal lamp wherein a focus of the rotational parabolic surface of the reflective mirror 33 is located at the light emitting diode chip 32*a*, according to the present invention, a focus F of the rotational parabolic surface of the reflective mirror 3 is located at the position coincident to the apex of a lens portion 2*b* or at the position in the vicinity of the apex of the lens portion 2*b*.

Next, optical functions and advantageous effects resulting from the arrangement wherein the focus F of the reflective mirror 3 is located at the position coincident to the apex of the lens portion 2*b* or at the position in the vicinity of the apex of the lens portion 2*b* will be described in more detail in the following.

Figure 2:
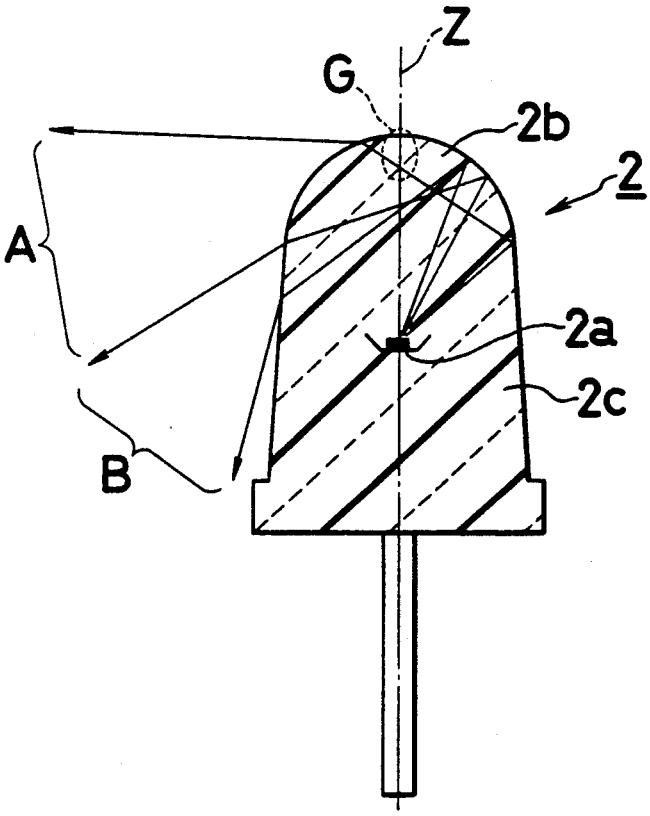
FIG. 2 is an enlarged sectional view of a single light emitting diode for the signal lamp in FIG. 1.

FIG. 2 is an enlarged sectional view of the light emitting diode 2 which is designed such that a large part of light generated by the light emitting diode chip 2*a* is emitted directly from the light emitting diode chip 2*a* so as to allow it to be radiated to the outside through the lens portion 2*b* at a predetermined radiating angle (ranging from 10° to 12° as measured from an optical axis Z).

In fact, it has been confirmed, based on the results derived from the inventor's elaborate observation on the light emitting diode 2, that light to be emitted therefrom should not be limited only to the light which has been emitted within the range defined by the predetermined angle but a small quantity of light is emitted through the whole surface of a case 2*c* molded of synthetic resin which is located outside of the aforementioned angle range and that emission of the light through the entire surface of the case 2*c* is mainly attributable to reflection of the light at the inner surface of the case 2*c*.

In addition, it has been found based on the results derived from the inventor's examination on plural kinds of commercially available light emitting diodes, that a considerably large part of the light which has been emitted to the outside after reflection at the inner surface of the case 2*c* is radiated while following one of the loci as noted below.

(1) A locus (as defined by a range A in FIG. 2) wherein light is reflected at the lens portion 2*b* peripheral to the straight part of the case 2*c* and the reflected light is then emitted to the outside via diffraction in the lens portion 2*b*.

(2) A locus (as defined by a range B in FIG. 2) wherein light is reflected at the lens portion 2*b* and the reflected light is then emitted to the outside via diffraction in the straight part of the case 2*c*.

Further, it has been found that, since the light which has been emitted to the outside while following either one of the aforementioned loci is related to the lens portion 2*b*, the foremost ends of extension lines of the emitted light beam extending backwardly to the emission side are concentrated at the position in the vicinity of the apex of the lens portion 2*b* and a virtual light source G appears at the foregoing position.

The present invention has been made based on the results derived from the aforementioned observation and examination, and a characterizing feature of the present invention consists in that the position assumed by the focus F of the reflective mirror 3 substantially coincides with the virtual light source G.

As described above, according to the present invention, the reflective mirror for each light emitting diode is designed in the shape of a rotational parabolic surface of which focus is located at the position coincident with the apex of the lens portion or at the position in the vicinity of the apex of the lens portion thereof, whereby a virtual light source appearing on the dome type light emitting diode is located at the position coincident to the focus of the reflective mirror or at the position in the vicinity of the focus of the reflective mirror. As a result, the entire surface of the reflective mirror is brightly illuminated without fluctuation of brightness on the lens portion of the light emitting diode, resulting in improved properties of the aforementioned kind of signal lamp being assured.

While the present invention has been described above only with respect to a single preferred embodiment, it should of course be understood that the present invention should not be limited only to this but various changes or modifications may be made without departure from the scope of the invention as defined by the appended claims.

What is claimed is:

1. In a signal lamp for a vehicle composed of a plurality of dome-type light emitting diodes and a plurality of reflective mirrors arranged corresponding to said light emitting diodes, each comprising a diode chip encapsulated in a transparent body having a generally cylindrical shape and terminating in a hemispheric-shaped top, said chip being arranged to lie substantially along the longitudinal axis of said transparent body at a spaced distance from the intersection of the longitudinal axis and the periphery of said hemispheric-shaped top, and a lens positioned to pass light rays directly from said light emitting diodes and reflected from said reflective mirrors, the improvement wherein each of said reflective mirrors is designed in the shape of a parabolic surface of revolution whose axis of revolution is substantially coincident with the longitudinal axis of its associated light emitting diode and whose focus is located substantially at a position coincident with said intersection or a position in the vicinity of said intersection to cause more uniform distribution of light rays from each light emitting diode over the surface of the reflective mirror associated therewith.

2. The signal lamp as claimed in claim 1, wherein said rotational parabolic surface is contoured such that a virtual light source appearing on each light emitting diode is located at a position substantially coincident with the focus of the corresponding reflective mirror or at the position in the vicinity of the focus of the corresponding reflective mirror.

3. The signal light as claimed in claim 1, wherein each light emitting diode is sealably received in a transparent cylindrical case molded of synthetic resin such that a large part of light generated by said light emitting diode chip is emitted directly from the light emitting diode chip so as to allow it to be radiated to the outside through a lens portion at a radiating angle ranging from 10° to 12° as measured from an optical axis.

4. The signal lamp as claimed in claim 3, wherein each light emitting diode chip is sealably received in said transparent body which is contoured such that another part of the light generated by said light emitted diode is reflected at a portion of the hemispheric-shaped top peripheral to the cylindrical portion of said transparent body and the reflected light is then emitted to the outside of the transparent body and toward the parabolic surface of the reflective mirror via diffraction by the cylindrical portion of the transparent body.

5. The signal light as claimed in claim 3 wherein each light emitting diode is sealably received in said transparent body having a periphery which is contoured such that a portion of the light generated by said light emitting diode is reflected by a portion of the lens which is peripheral to the cylindrical portion of said transparent body and the reflected light is then emitted to the outside of the transparent body and toward the parabolic surface of the reflective mirror via diffraction by said transparent body.

6. In a signal lamp for a vehicle comprising a plurality of dome-type light emitting diodes and a plurality of reflective mirrors each associated with one of said light emitting diodes, the improvement wherein each of said dome-type light emitting diodes comprises a light emitting diode element sealably received within a substantially cylindrical shaped transparent body molded of a synthetic resin, said cylindrical shaped body terminating in a dome-shaped end;

said light emitting diode element being positioned substantially along the longitudinal axis of said transparent body a spaced distance beneath the intersection of said longitudinal axis and the dome-shaped end; and each of said reflective mirrors having the shape of a parabolic surface or revolution whose axis of revolution is substantially coincident with the longitudinal axis of said transparent body an whose focus is located substantially at a position coincident with the intersection of said longitudinal axis and the dome shaped end of its associated light emitting diode.

7. The signal lamp of claim 6 wherein the parabolic surface of rotation is contoured such that a virtual light source appearing at its associated light emitting diode is located at a position substantially coincident with the focus of the corresponding reflective mirror.

8. In a signal lamp for a vehicle comprising a plurality of dome-type light emitting diodes and a plurality of reflective mirrors each associated with one of said light emitting diodes, the improvement wherein each of said dome-type light emitting diodes comprises a light emitting diode element sealably received within a substantially cylindrical shaped transparent body molded of a synthetic resin, said cylindrical shaped body terminating in a dome-shaped end;

said light emitting diode element being positioned substantially along the longitudinal axis of said transparent body a spaced distance beneath the intersection of said longitudinal axis and the dome-shaped end; and each of said reflective mirrors having the shape of a parabolic surface or revolution whose axis of revolution is substantially coincident the longitudinal axis of said transparent body and whose focus is located substantially in the vicinity of the intersection of said longitudinal axis and the dome shaped end of said light emitting diode.

9. The signal lamp of claim 8 wherein the parabolic surface of rotation is contoured such that a virtual light source appearing at its associated light emitting diode is located at a position in the vicinity of the focus of the corresponding reflective mirror.

* * * * *

UNITED STATES PATENT AND TRADEMARK OFFICE

CERTIFICATE OF CORRECTION

PATENT NO. : 5,093,768

DATED : March 3, 1992

INVENTOR(S) : Kouji Ohe

It is certified that error appears in the above-identified patent and that said Letters Patent is hereby corrected as shown below:

Column 5, line 7, "emitted" should be --emitting--

Column 6, line 28, "or" should be --of--

Column 6, line 29, after "coincident" insert --with--

Signed and Sealed this

Fourth Day of May, 1993

*Attest:*

Michael K. Kirk

MICHAEL K. KIRK

*Attesting Officer*

*Acting Commissioner of Patents and Trademarks*